US006036117A

United States Patent [19]

Heren et al.

[11] Patent Number: 6,036,117

[45] Date of Patent: Mar. 14, 2000

[54] HOSE NOZZLE

[75] Inventors: Lawrence P. Heren, East Peoria, Ill.; Thomas R. Keuer, Edgewood, Ky.

[73] Assignee: L.R. Nelson Corporation, Peoria, Ill.

[21] Appl. No.: 09/134,234

[22] Filed: Aug. 14, 1998

[51] Int. Cl.[7] ..... B05B 1/32

[52] U.S. Cl. ..... 239/456; 239/530

[58] Field of Search ..... 239/451, 456, 239/530, 539, 581.2, 579, 394

[56] References Cited

U.S. PATENT DOCUMENTS

| | | | |
|---|---|---|---|
| D. 141,185 | 5/1945 | Stanitz . | |
| D. 157,473 | 2/1950 | Engler . | |
| D. 213,556 | 3/1969 | Sheeter . | |
| D. 237,708 | 11/1975 | Grobe . | |
| D. 319,289 | 8/1991 | Heren . | |
| D. 319,296 | 8/1991 | Heren . | |
| D. 325,620 | 4/1992 | Heren . | |
| 2,684,268 | 7/1954 | Hjulian . | |
| 2,989,250 | 6/1961 | Simon | 239/456 |
| 3,001,725 | 9/1961 | Lockett . | |
| 3,102,691 | 9/1963 | Gall . | |
| 4,903,897 | 2/1990 | Hayes . | |
| 4,930,704 | 6/1990 | Chen . | |
| 4,997,131 | 3/1991 | Heren . | |
| 5,160,093 | 11/1992 | Battaglia . | |
| 5,303,868 | 4/1994 | Kroll . | |
| 5,615,837 | 4/1997 | Roman . | |

*Primary Examiner*—Steven O. Douglas
*Assistant Examiner*—Huyen Le
*Attorney, Agent, or Firm*—Mayer, Brown & Platt

[57] ABSTRACT

A hose nozzle allowing one hand control for water stream pattern and flow rate is disclosed. The hose nozzle has a tubular body having a connector end for mating with the connector end of a hose. A hand grip having a plurality of finger notches is located around the tubular body. The hand grip allows the nozzle to be held between a user's fingers and palm. An outer sleeve member and an annular beveled collar are located in sufficient proximity to the hand grip to allow manual actuation by a user's index finger and thumb. The outer sleeve member and the annular collar may be extended or retracted by rotation. The outer sleeve member has a closed end wall with an aperture. An inner stem is located within the outer sleeve and is in fluid communication with the tubular body. The inner stem has an orifice which allows water to flow out of the inner stem and through the aperture when the outer cylinder is extended. Water flow is controlled by rotating the annular collar to permit water to flow through the tubular body, the inner stem, orifice and out of the aperture of the outer sleeve member.

22 Claims, 2 Drawing Sheets

HOSE NOZZLE

FIELD OF INVENTION

This invention relates to hose nozzles. More specifically, this invention relates to a manually actuable hose nozzle allowing comfortable operation with one hand.

BACKGROUND OF INVENTION

Garden hoses are commonly known irrigation devices. In order to direct the water stream from the hose end in a variety of patterns such as a jet stream or a cone shaped spray, screw-on hose nozzles have been devised. Typical hose nozzles come in two varieties: 1) barrel type hose nozzles and 2) pistol-grip hose nozzles. The barrel type hose nozzle is usually in the form of a generally cylindrical body. One end of the body is adapted to be connected to the garden hose and the opposite end defines the nozzle from which the water stream issues. The body has a forward cylindrical element which may be retracted or extended in relation to a rear cylindrical element by rotating the forward cylindrical element. The pattern of the water stream issuing from the nozzle may be adjusted by rotating the forward cylindrical element into different positions. The flow rate of the water stream issuing from the nozzle is also related to the position of the forward cylindrical element.

The use of two hands is required in order to position the forward element. One hand is used to hold the hose and the other is used to turn the forward barrel element with respect to the rearward element. The range of adjustment allows for variation of the water stream pattern issuing from the nozzle orifice and the flow rate. However, using two hands to control the water stream is cumbersome to the user and does not provide simultaneous use of a free hand.

In contrast, a typical pistol-grip nozzle includes a tubular body having a handle portion connectable at one end to the garden hose. The body has a fixed barrel portion extending from the opposite end of the hose connector at an angle similar to the angle between the handle and barrel of a pistol. The water stream issues from the nozzle at the forward end of the barrel. The pattern and flow rate of the water stream is determined by a valve stem extending through the barrel portion and outwardly through the rear end thereof. The movement of the stem is controlled by a pivoted actuating lever which includes a portion generally parallel with the handle of the nozzle body enabling the user to grip the handle portion and actuating lever and to adjust the water stream issuing from the nozzle by a simple squeezing action. Usually, a pivoted bail is provided for holding the actuating lever and adjusting stem in any desired position. Certain pistol-grip type hose nozzles allow a user to separately control the pattern of the water stream and the flow rate but require two handed operation.

An advantage of the pistol-grip type hose nozzle in comparison with the barrel type hose nozzle is the ease with which the stream varying structure may be moved into and out of its fully closed position from and into any operating position. Additionally, a user may operate the pistol nozzle with only one hand since only one hand is required both to hold the nozzle and squeeze the lever to actuate the water stream. However, the user has to hold the actuating lever against a spring action in the operating position or operate the bail to maintain the desired water stream pattern. In contrast, barrel type nozzles are self-maintained in any position of adjustment into which they are moved. Also, the pistol type grips are generally more complex and costly to manufacture than barrel type nozzles. Finally, the pistol-grip nozzle requires a user's arm to be extended in order to direct the water stream from the nozzle. This results in fatigue since the user's arm must be raised to direct the water stream from the nozzle.

Thus, there exists a need for a simple barrel type hose nozzle which will allow adjustment of the water stream with one hand. There is also a further need for a simple barrel type hose nozzle which allows a user to set the force and pattern of the water stream with one hand. There is also a need for a barrel type hose nozzle with an ergonomic grip for the comfort of a user's hand. There is additionally a need for a barrel type hose nozzle which allows direction of a water stream without exerting a user's arm.

SUMMARY OF THE INVENTION

The present invention is embodied in a hose nozzle for use with a hose having one end connected to a fluid source and an opposite connector end. The hose nozzle has a hollow body having a connector end mateable with the connector end of the hose and a hand grip shaped to fit a user's hand. A fluid flow pattern varying assembly is located in sufficient proximity to the hollow body to allow manual actuation by a user's index finger and thumb. An outlet member is coupled to the fluid flow pattern varying assembly. The hollow body permits fluid flow on the manual actuation of the fluid flow pattern varying assembly. A fluid passage extends through the hollow body permitting fluid to flow from the hose to the outlet member.

More specifically, the invention is directed toward a hose nozzle for controlling and varying a water stream from a hose. The hose has one end fluidly coupled to a pressurized water source and an opposite open end. The hose nozzle has a generally tubular body with a connector end coupled to the opposite open end of the hose. The tubular body has an interior cylindrical passage permitting flow of water from the hose through the tubular body. The tubular body also has a hand grip. An inner stem member is coupled to the end of the tubular body opposite from the connector end. The inner stem member has one open end permitting passage of water therethrough. The inner stem member also has an opposite closed end and an orifice permitting passage of water therethrough proximate the opposite closed end. The inner stem member also has a beveled cylinder on the closed end and a threaded exterior surface proximate the open end. An outer sleeve member has an open end with a threaded interior surface intermeshed with the threaded exterior surface of the inner cylinder. This permits the outer sleeve member to be retracted or extended in relation to the inner stem member by rotating it about the inner stem member. The outer sleeve member has an end wall opposite the open end with an aperture with a sufficient diameter to allow the passage of a portion of the beveled cylinder. The hand grip is shaped to allow a user's hand to hold the tubular body and rotate the outer sleeve member.

It is to be understood that both the foregoing general description and the following detailed description are not limiting but are intended to provide further explanation of the invention claimed. The accompanying drawings, which are incorporated in and constitute part of this specification, are included to illustrate and provide a further understanding of the method and system of the invention. Together with the description, the drawings serve to explain the principles of the invention.

DESCRIPTION OF THE PREFERRED EMBODIMENT

Figure 1:
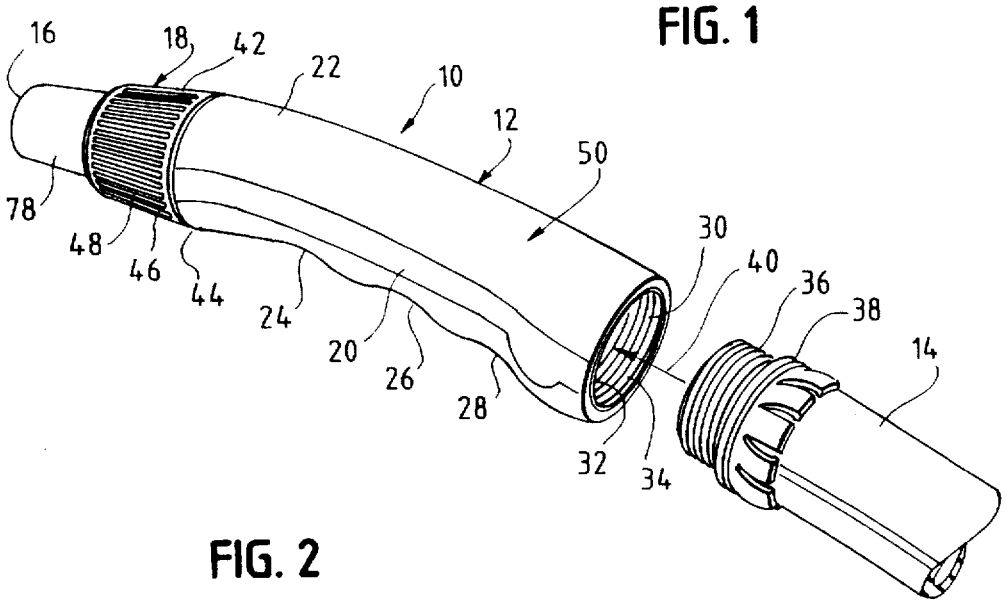
FIG. 1 is a perspective view of a hose nozzle in a closed position according to the present invention.

While the present invention is capable of embodiment in various forms, there is shown in the drawings and will hereinafter be described a presently preferred embodiment with the understanding that the present disclosure is to be considered as an exemplification of the invention, and is not intended to limit the invention to the specific embodiment illustrated.

Figure 2:
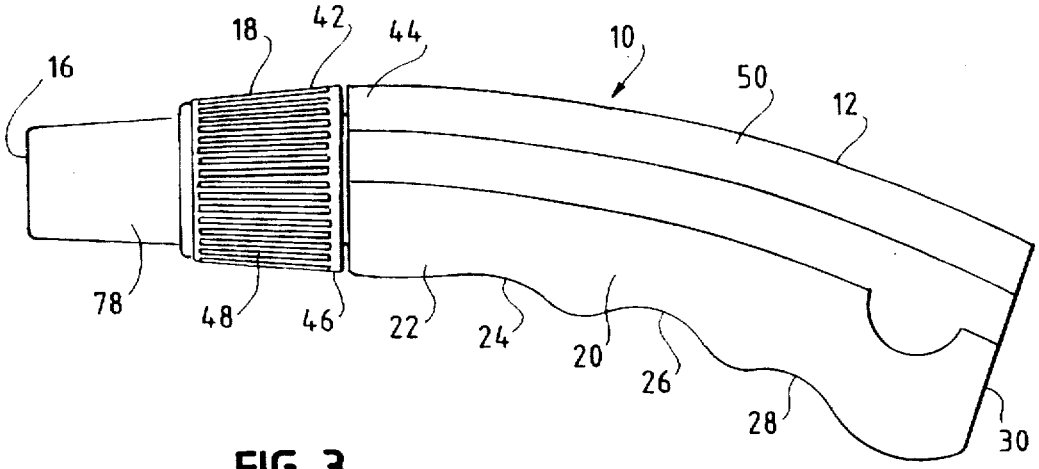
FIG. 2 is a side view of the hose nozzle of FIG. 1 in a closed position according to the present invention.
Figure 3:
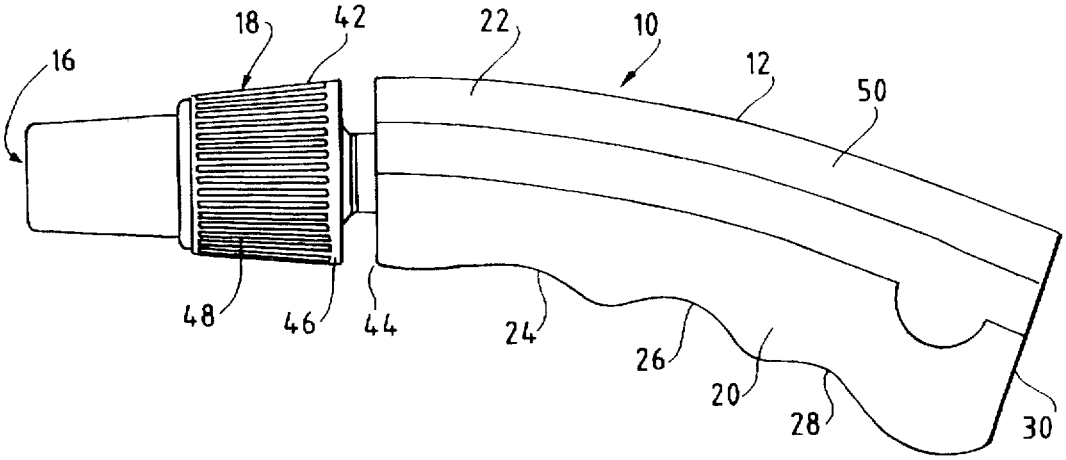
FIG. 3 is a side view of the hose nozzle of FIG. 1 in an open position according to the present invention.

Referring now to the drawings and more particularly to FIGS. 1–3 which show perspective and side views of a hose nozzle generally indicated at 10, embodying the general principles of the present invention. In general, the hose nozzle 10 includes a hollow body member such as a generally tubular body 12 adapted to be connected to one end of a hose 14. The hose 14 is a typical garden hose having its opposite end connected to a fluid source such as a water spigot (not shown). The hose nozzle 10 has an outlet member 16 which has a manually actuable flow pattern varying assembly 18. The tubular body 12 and outlet member 16 are operable to receive water under pressure from the hose 14 at a flow rate determined by the manually activated flow rate varying assembly 18. The barrel portion 16 issues the water stream with different stream patterns and force determined by the position of the manual actuation assembly 18 in relation to the tubular body 12.

Figure 4:
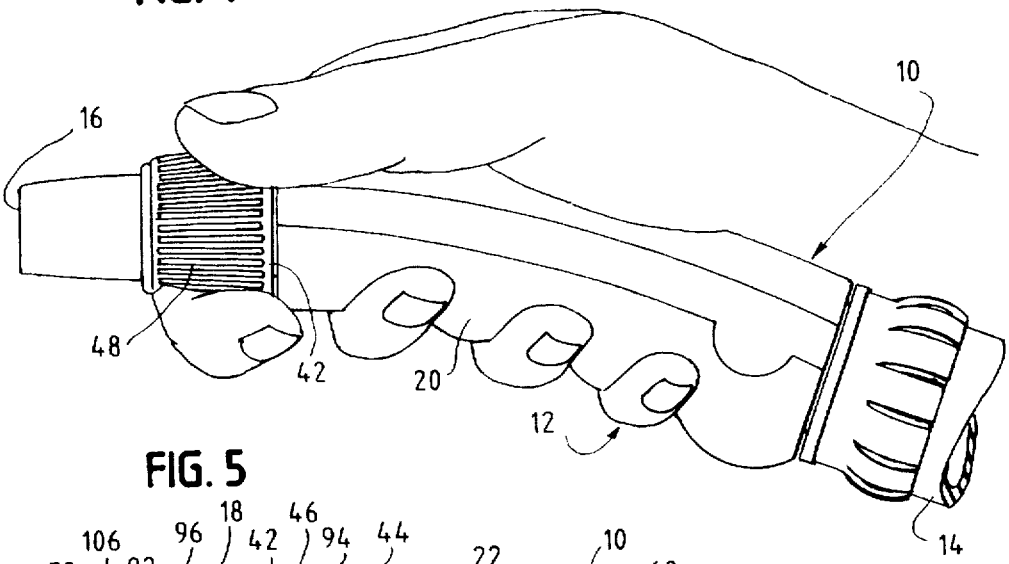
FIG. 4 is a side view of the hose nozzle of FIG. 1 according to the present invention in relation with the hand of a user.

The exterior of the tubular body 12 has an integral hand grip 20. The hand grip 20 and the tubular body 12 are ergonomically shaped to permit the grasp of a user's hand as shown in FIG. 4. The tubular body 12 has an angled portion 22 which is connected to the barrel portion 16. The hand grip 20 is preferably made of a resilient and soft material such as rubber or an elastomeric polymer in order to facilitate the gripping of the tubular body 12. The grip 20 is of sufficient thickness to provide a user's hand insulation from the temperature of the water flowing through the tubular body 12. The hand grip 20 has three finger notches 24, 26 and 28 which facilitate the placement of a user's fingers holding the nozzle 10. The hand grip 20 is of sufficient length to allow the tubular body 12 to fit within an average user's hand as shown in FIG. 4. The hand grip 20 may have other shapes which allow the comfortable gripping of the body 12 by a user's hand.

Returning to FIGS. 1–3, the tubular body 12 has an open end portion 30 which is connectable to the hose 14. The open end portion 30 has an interior surface 32 which is formed with hose end connecting means such as female threads 34 of a size to intermesh with male threads 36 on a typical connector end fitting 38 on the hose 14. The threads 34 form a part of a water passage 40 which extends through the open end portion 30, through the tubular body 12 and the outlet member 16 of the nozzle 10. Of course, other means of connection to a hose may be used instead of the male and female coupling threads if desired.

The manually actuable flow pattern varying assembly 18 includes an annular collar 42 and an outer sleeve member 78 which are disposed on a closed end 44 of the tubular body 12 opposite from the open end portion 30. The annular collar 42 and the outer sleeve member may be extended or retracted relative to the tubular body 12 by rotation. The flow pattern varying assembly 18 is used to vary the flow rate of water under pressure confined within the water passage 40 between zero and maximum. Thus, when the annular collar 42 and outer sleeve member 78 are in a retracted position as shown in FIGS. 1 and 2, water flow from the nozzle 10 is zero. When the annular collar 42 and outer sleeve member 78 are in the fully extended position as shown in FIG. 3, water flow from the nozzle 10 is at maximum. The annular collar 42 has a beveled exterior surface 46 with a series of ridges 48 to facilitate gripping by the user. In the preferred embodiment, the annular collar 42 is made of plastic although any sturdy, waterproof material such as brass or zinc alloy may be used.

In the position relative to the placement of the user's fingers on the finger notches 24, 26 and 28 of the handgrip 20, the user's thumb and forefinger are naturally extended to grip the beveled exterior surface 46 of the annular collar 42. In this regard, it will be noted that the exterior surface of the hand grip 20 has a top surface area 50 in a position opposed to the finger grip notches 24, 26 and 28 on the bottom surface of the hand grip 20. The top surface area 50 is shaped to accommodate a user's palm as shown in FIG. 3. With this arrangement, it will be noted that the exterior surface of the hand grip 20 will accommodate either a right hand grip or a left hand grip with equal facility so as to accommodate the particular dexterity of any particular user.

Figure 5:
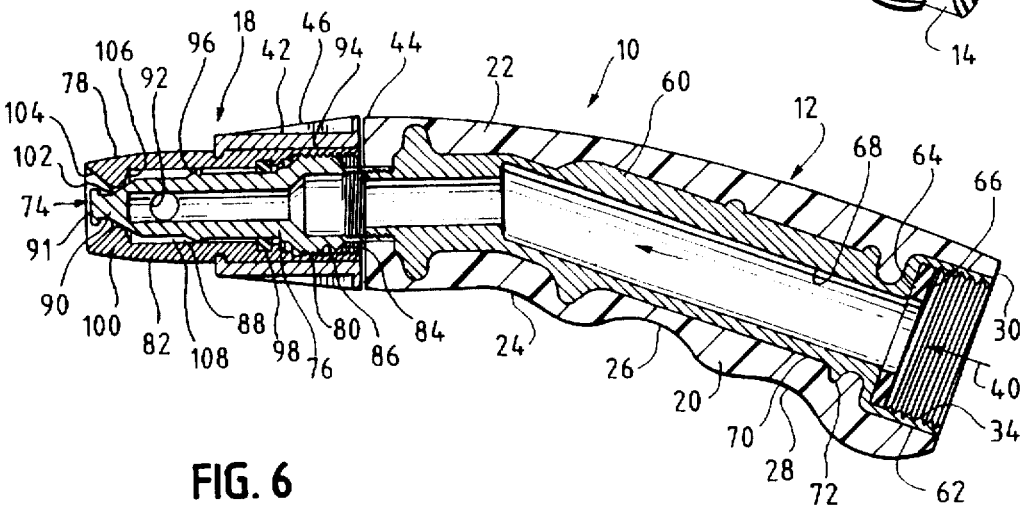
FIG. 5 is a cross section view of the hose nozzle of FIG. 1 according to the present invention in a closed position.
Figure 6:
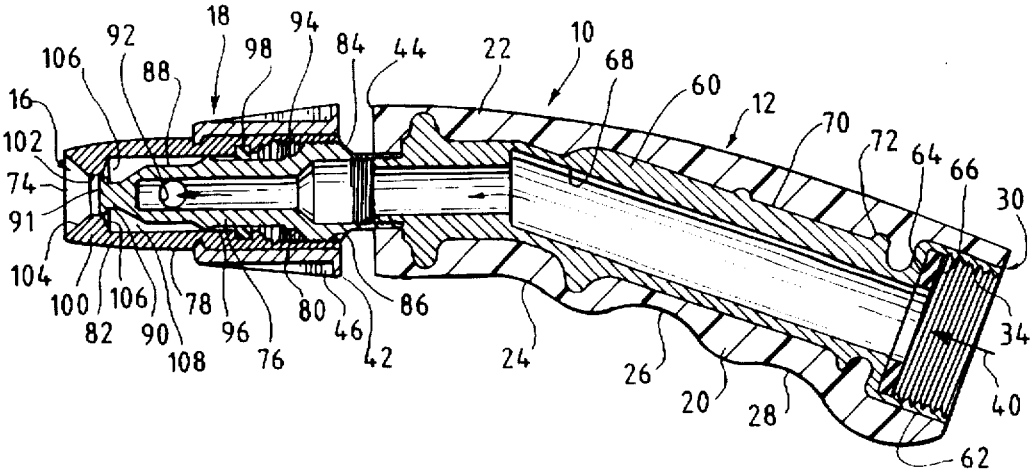
FIG. 6 is a cross section view of the hose nozzle of FIG. 1 according to the present invention in an open position.

FIGS. 5 and 6 are cross sectional views of the nozzle 10 in a closed and open position respectively. Like elements in FIGS. 5 and 6 have identical numbers as in FIGS. 1–3. The interior of the tubular body 12 contains a shaped cylindrical member 60. The cylindrical member 60 is preferably a water resistant material such as plastic or zinc alloy.

The cylindrical member 60 has a connector portion 62 which contains the female threads 34 and forms the first part of the water passage 40. The hose end connector 38 of the hose 14 is twisted into the connector portion 62. The connector portion 62 has an annular shoulder 64 which serves to stop the hose end connector 38 of the hose 14. An elastomeric hose washer 66 is inserted on the annular shoulder 64 to facilitate sealing the annular shoulder 64 to the hose end connector 38.

The cylindrical member 60 has a smooth interior surface 68 which forms a cylindrical passage for the water passage 40 to proceed through the tubular body 12. The water passage 40 is bent at an angle to follow the cylindrical member 60 and the angle portion 22 of the tubular body 12. An exterior surface 70 of the cylindrical member 60 has a series of annular ridges 72 which rest in similar notches on the hand grip 20. The combination of the annular ridges 72 and the notches on the hand grip 20 serve to securely hold the hand grip 20 to the cylindrical member 60. Alternatively, the cylindrical member 60 and hand grip 20 may be a single piece. The single piece may be made of zinc or a rigid plastic such as by injection or blow molding.

The outlet member 16 extends from the closed end 44 of the tubular body 12 and provides an outlet 74 for a pressurized stream of water from the hose 14. The outlet member 16 includes an inner stem member 76. The outer sleeve 78 is placed circumferentially around the inner stem member 76. Both the inner stem member 76 and outer sleeve member 78 are preferably water resistant material such as brass or plastic in the preferred embodiment. Alternatively, other materials such as zinc alloy may be used. The annular collar 42 is fixedly attached to the exterior surface of a rear portion 80 of the outer sleeve member 78 by means of friction from a knurled contact surface (not shown) on the outer sleeve member 78. Alternatively, the annular collar 42 may be attached to the outer sleeve member 78 as a mold insert. The annular collar 42 and the outer sleeve member 78 may also be fabricated as a single piece. A forward portion 82 of the outer sleeve member 78 extends from the annular collar 42 and forms the outlet 74.

The inner stem member 76 has a base portion 84. The base portion 84 is hollow and serves as the continuation of the water passage 40. The base portion 84 has a threaded exterior surface 86. The base portion 84 of the inner stem member 76 is coupled to a tube portion 88. The tube portion 88 is hollow and terminates the water passage 40. The base portion 84 has a wider diameter than that of the tube portion 88. The inner stem member 76 has a solid beveled cylinder 90 whose wider end closes the tube portion 88. The opposite end of the beveled cylinder 90 has a cap 91, which in conjunction with the beveled cylinder 90, serves to direct water flow from the outlet end 74 of the barrel portion 16. An orifice 92 is located on the tube portion 88. The orifice 92 allows water in the water passage 40 to escape the interior of the inner stem member 76.

The outer sleeve member 78 has a threaded interior surface 94 which is meshed with the threaded exterior surface 86 of the inner stem member 76. The outer sleeve member 78 and the attached annular collar 42 thus may be extended or retracted in relation to the inner stem member 76 and the tubular body 12 by the user rotating the annular collar 42 in a clockwise or counter clockwise-direction.

The inner stem member 76 has an annular stop 96 on its exterior surface behind the orifice 92. An O-ring 98 is installed around the exterior surface of the inner stem member 76 in front of the threaded exterior surface 86. The outer sleeve member 78 may be extended by rotation to the point where the O-ring 98 contacts the annular stop 96. The combination of the annular stop 96 and the O-ring 98 thus prevents the outer sleeve member 78 from becoming detached from the inner stem member 76.

The outer sleeve member 78 is closed by an end wall 100 which has an aperture 102 which is approximately the same diameter as the beveled cylinder 90 of the inner stem member 76. The end wall 100 has a beveled outer surface 104 around the aperture 102. The beveled outer surface 104 in conjunction with the beveled cylinder 90 and cap 91 serves to direct the water stream in a spray pattern. The end wall 100 also has a flat inner surface 106 which contacts the beveled cylinder 90 when the outer sleeve member 78 is in a retracted position.

The space between inner stem member 76 and outer sleeve member 78 forms a cavity 108 which provides fluid access through the orifice 92 to the water passage 40. When the outer sleeve member 78 is fully retracted, the beveled cylinder 90 of the inner stem member 76 partially extends through the aperture 102. The beveled cylinder 90 in combination with the inner surface 106 of the end wall 100 prevents water forced into the cavity 108 by water pressure from flowing out of the aperture 102. The O-ring 98 forms a seal between the interior of the outer sleeve member 78 and the exterior of the inner stem member 76. Thus, water in the cavity 108 cannot flow out through the threaded surfaces 86 and 94.

When the outer sleeve member 78 is extended as shown in FIG. 6, the aperture 102 and the end wall 100 are moved forward, allowing passage of water from the cavity 108 around the beveled cylinder 90 and through the aperture 102. The water is forced out from the water flow in the hose 14 which is propelled through the water passage 40, through the orifice 92, the water cavity 108, and out the aperture 102.

As shown in FIG. 4, the finger notches 24, 26 and 28 allow a user to grasp the hose nozzle 10 with three fingers around the hand grip 20. Due to the orientation of the tubular body 12 and the angled portion 22, the user's thumb and index finger rest naturally on the annular collar 42. By rotating the annular collar 42 by using the thumb and index finger, the user is able to extend the outer sleeve member 78 in relation to the inner stem member 76 and the tubular member 12 as shown in FIGS. 3 and 6. This changes the pattern of the water stream emitted from the outlet 74. The water stream pattern is determined by the position of the beveled cylinder 90 and cap 91 in relation to the beveled surface 104 of the outer sleeve member 78. The water stream pattern may range from a cone shaped spray when the outer sleeve member 78 is almost fully retracted to a jet stream when the outer sleeve member 78 is fully extended.

The intermeshing threads 86 and 94 on the inner stem member 76 and outer sleeve member 78 allow the annular collar 42 and the attached outer sleeve member 78 to be fixed at any position between the fully extended position and the fully retracted position. In this manner, a variety of water spray patterns may be controlled by the user without maintaining pressure from the thumb and index finger on the annular collar 42.

The present invention allows a user to operate the hose nozzle 10 using either hand. The resilient and soft material of the hand grip 20 over the tubular portion 12 as well as the angled shape allows a soft and comfortable hold for the user. Additionally, the handgrip 20 insulates a user's hand from the temperature of the water flowing through the tubular body 12. The angled portion 22 of the tubular body 12 allows the water stream issued from the nozzle 10 to be directed toward an area by simply pivoting the user's wrist with the arm in a vertical position. This prevents fatigue to the user's arm.

It will be apparent to those skilled in the art that various modifications and variations can be made in the method and system of the present invention without departing from the spirit or scope of the invention. Thus, the present invention is not limited by the foregoing descriptions but is intended to cover all modifications and variations that come within the scope of the spirit of the invention and the claims that follow.

What is claimed is:

1. A hose nozzle for use with a hose having one end connected to a fluid source and an opposite connector end, the hose nozzle comprising:

a hollow body having a connector end mateable with the connector end of the hose and a hand grip shaped to fit a user's hand;

a fluid flow pattern varying assembly in sufficient proximity to the hollow body to allow manual actuation by the index finger and thumb of the user's hand wherein said fluid flow pattern varying assembly has a symmetrical cross section and a longitudinal axis perpendicular to said cross section;

an outlet member coupled to the fluid flow pattern varying assembly and the hollow body which permits fluid flow on the manual actuation of the fluid flow pattern varying assembly; and a fluid passage extending through the hollow body permitting fluid to flow from the hose to the outlet member parallel to said longitudinal axis.

2. The nozzle of claim 1 wherein the hand grip is a resilient and soft material.

3. The nozzle of claim 2 wherein the hand grip is an elastomeric polymer.

4. The nozzle of claim 1 wherein the hand grip is rubber.

5. The nozzle of claim 1 wherein the hollow body is rigid plastic.

6. The nozzle of claim 1 wherein the hand grip has a top surface allowing the placement of a user's palm and a bottom surface with three finger notches.

7. The nozzle of claim 1 wherein the hollow body is bent at an angle relative to the outlet member allowing the water flow to be directed by a user's wrist when the user's arm is in a substantially vertical position.

8. The nozzle of claim 1 wherein the fluid flow pattern varying assembly includes an outer sleeve member and an annular collar fixedly attached circumferentially around the outer sleeve member.

9. The nozzle of claim 8 wherein the annular collar has a beveled exterior surface having ridges to permit gripping by the user's thumb and index finger.

10. The nozzle of claim 8 wherein the outlet member includes an inner stem member having a hollow area with fluid access to the fluid passage, further having a threaded exterior portion and an orifice allowing fluid passage through the inner stem member, wherein the inner stem member is located inside the outer sleeve member; and wherein the outer sleeve member has a threaded interior surface which meshes with the threaded exterior surface allowing the outer sleeve member and the annular collar to be extended or retracted by rotating the outer sleeve member in relation to the inner stem member.

11. The nozzle of claim 10 wherein the inner stem member includes a beveled cylinder having a cap, the beveled cylinder being located opposite the exterior threaded surface; and wherein the outer sleeve member has an end wall with an aperture with sufficient diameter for partial insertion of the beveled cylinder; and wherein a cavity is formed between the inner stem and outer sleeve members with fluid access through the orifice in the inner stem member.

12. The nozzle of claim 10 wherein the inner stem and outer sleeve members are brass.

13. The nozzle of claim 8 wherein the annular collar is plastic.

14. A hose nozzle for controlling and varying a water stream from a hose having one end fluidly coupled to a pressurized water source and an opposite open end, the hose nozzle comprising:

a generally tubular body having a connector end coupled to the opposite open end of the hose, the tubular body having an interior cylindrical passage permitting flow of water from the hose through the tubular body and an exterior hand grip;

an inner stem member coupled to the opposite end of the tubular body from the connector end, the inner stem member having one open end permitting passage of water therethrough, an opposite closed end, and an orifice permitting passage of water therethrough proximate the opposite closed end, the inner stem member having a beveled cylinder on the closed end and a threaded exterior surface proximate the open end;

an outer sleeve member having an open end with a threaded interior surface intermeshed with the threaded exterior surface of the inner stem member permitting the outer sleeve member to be retracted or extended in relation to the inner stem member by rotation about the inner stem member, the outer sleeve member having an end wall opposite the open end with an aperture with a sufficient diameter to allow the passage of a portion of the beveled cylinder; and wherein the hand grip is shaped to allow a user's hand to hold the tubular body and rotate the outer sleeve member.

15. The hose nozzle of claim 14 further comprising an annular collar attached to at least a portion of the exterior surface of the outer sleeve member.

16. The hose nozzle of claim 15 wherein the annular collar has a beveled exterior surface and permits a user's index finger and thumb to rotate the annular collar.

17. The nozzle of claim 14 wherein a cap is attached to the beveled cylinder on the end opposite the end attached to the open end of the inner stem.

18. The hose nozzle of claim 14 wherein the hand grip has a bottom surface with a plurality of finger notches and a top surface shaped to allow placement of a user's palm.

19. The nozzle of claim 18 wherein the hand grip is an elastomeric polymer.

20. The nozzle of claim 18 wherein the hand grip is rubber.

21. The nozzle of claim 14 wherein the tubular body is bent at an angle relative to the inner stem and outer sleeve members allowing the water flow to be directed by a user's wrist when the user's arm is in a substantially vertical position.

22. The hose nozzle of claim 14 wherein the inner stem and outer sleeve members are brass.

* * * * *

Disclaimer

6,036,117—Lawrence P. Heren, East Peoria, IL; Thomas R. Keuer, Edgewood, Ky. HOSE NOZZLE. Patent dated March 14, 2000. Disclaimer filed April 20, 2005, by the assignee, L.R. Nelson Corporation, Peoria, IL.

Hereby enter this disclaimer to claims 1-22 of said patent.

*(Official Gazette, July 26, 2005)*

US006036117C1

(12) EX PARTE REEXAMINATION CERTIFICATE (5349th)

United States Patent
Heren et al.

(10) Number: US 6,036,117 C1
(45) Certificate Issued: Apr. 18, 2006

(54) HOSE NOZZLE

(75) Inventors: Lawrence P. Heren, East Peoria, IL (US); Thomas R. Keuer, Edgewood, KY (US)

(73) Assignee: L.R. Nelson Corporation, Peoria, IL (US)

Reexamination Request:
No. 90/006,120, Sep. 27, 2001

Reexamination Certificate for:

| | |
|---|---|
| Patent No.: | **6,036,117** |
| Issued: | **Mar. 14, 2000** |
| Appl. No.: | **09/134,234** |
| Filed: | **Aug. 14, 1998** |

(51) Int. Cl.
*B05B 1/32* (2006.01)

(52) U.S. Cl. ..... 239/456; 239/530
(58) Field of Classification Search ..... 239/451, 239/456, 530, 539, 581.2, 579, 394
See application file for complete search history.

(56) References Cited

U.S. PATENT DOCUMENTS

| | | | | | |
|---|---|---|---|---|---|
| 570,757 | A | * | 11/1896 | Hirsch | 239/458 |
| 2,121,741 | A | * | 6/1938 | Lusher et al. | 239/458 |
| 2,121,747 | A | * | 6/1938 | Scholtes | 239/458 |
| 2,141,868 | A | * | 12/1938 | Kenney | 239/458 |
| 2,993,655 | A | * | 7/1961 | O'Brien | 239/458 |
| 3,514,042 | A | * | 5/1970 | Freed | 239/438 |
| 4,025,000 | A | * | 5/1977 | Blasnik | 239/459 |
| 4,129,257 | A | * | 12/1978 | Eggert | 239/458 |
| 4,840,313 | A | * | 6/1989 | Hansen | 239/456 |
| D372,297 | S | * | 7/1996 | Wang | D23/223 |
| D382,936 | S | * | 8/1997 | Shfaram | D23/213 |
| D382,937 | S | * | 8/1997 | Shfaram | D23/223 |
| D387,849 | S | * | 12/1997 | Wang | D23/223 |
| D390,914 | S | * | 2/1998 | Wang | D23/223 |
| D408,068 | S | * | 4/1999 | Hui-Chen | D23/223 |
| D408,889 | S | * | 4/1999 | Hui-Chen | D23/223 |
| D409,717 | S | * | 5/1999 | Heren et al. | D23/213 |

FOREIGN PATENT DOCUMENTS

| | | | |
|---|---|---|---|
| EP | 0803291 | A2 * | 10/1997 |
| IL | 25389 | | 12/1996 |

OTHER PUBLICATIONS

SunMate 1998 Catalog.*

* cited by examiner

*Primary Examiner*—Christopher S. Kim

(57) ABSTRACT

A hose nozzle allowing one hand control for water stream pattern and flow rate is disclosed. The hose nozzle has a tubular body having a connector end for mating with the connector end of a hose. A hand grip having a plurality of finger notches is located around the tubular body. The hand grip allows the nozzle to be held between a user's fingers and palm. An outer sleeve member and an annular beveled collar are located in sufficient proximity to the hand grip to allow manual actuation by a user's index finger and thumb. The outer sleeve member and the annular collar may be extended or retracted by rotation. The outer sleeve member has a closed end wall with an aperture. An inner stem is located within the outer sleeve and is in fluid communication with the tubular body. The inner stem has an orifice which allows water to flow out of the inner stem and through the aperture when the outer cylinder is extended. Water flow is controlled by rotating the annular collar to permit water to flow through the tubular body, the inner stem, orifice and out of the aperture of the outer sleeve member.

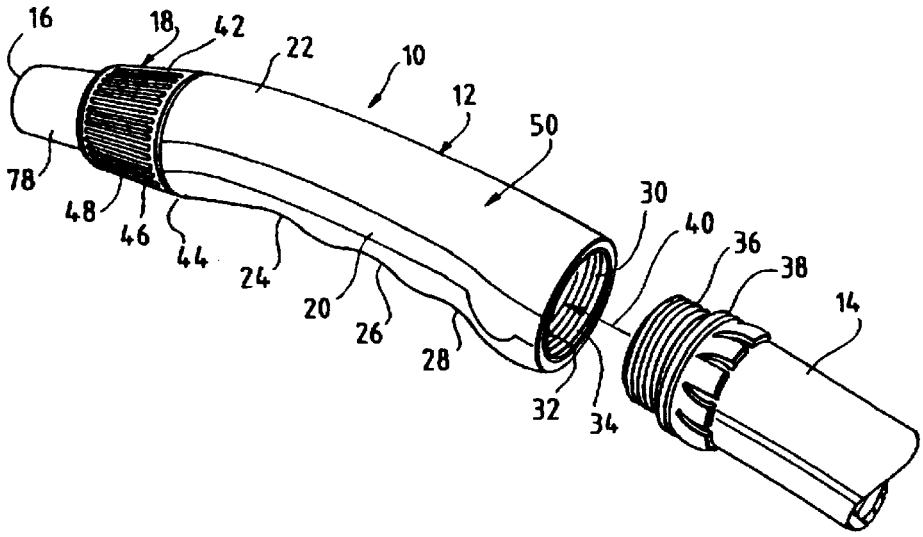

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

Claims 1–22 are now disclaimed.

1. A hose nozzle for use with a hose having one end connected to a fluid source and an opposite connector end, the hose nozzle comprising:

a hollow body having a connector end mateable with the connector end of the hose and a hand grip shaped to fit a user's hand;

a fluid flow pattern varying assembly in sufficient proximity to the hollow body to allow manual actuation by the index finger and thumb of the user's hand wherein said fluid flow pattern varying assembly has a symmetrical cross section and a longitudinal axis perpendicular to said cross section;

an outlet member coupled to the fluid flow pattern varying assembly and the hollow body which permits fluid flow on the manual actuation of the fluid flow pattern varying assembly; and a fluid passage extending through the hollow body permitting fluid to flow from the hose to the outlet member parallel to said longitudinal axis.

* * * * *